US008561246B2

(12) United States Patent
Johansson

(10) Patent No.: US 8,561,246 B2
(45) Date of Patent: Oct. 22, 2013

(54) DISPLACEABLE ATTACHMENT

(75) Inventor: Stefan Johansson, Västerås (SE)

(73) Assignee: Hygienteknik Sverige AB, Västerås (SE)

( * ) Notice: Subject to any disclaimer, the term of this patent is extended or adjusted under 35 U.S.C. 154(b) by 0 days.

(21) Appl. No.: 13/639,280

(22) PCT Filed: Feb. 2, 2011

(86) PCT No.: PCT/SE2011/050111
§ 371 (c)(1),
(2), (4) Date: Oct. 4, 2012

(87) PCT Pub. No.: WO2011/129741
PCT Pub. Date: Oct. 20, 2011

(65) Prior Publication Data

US 2013/0019428 A1 Jan. 24, 2013

(30) Foreign Application Priority Data

Apr. 12, 2010 (SE) ..... 1000358

(51) Int. Cl.
*A47L 13/20* (2006.01)

(52) U.S. Cl.
USPC ..... 15/144.1; 15/228; 29/428

(58) Field of Classification Search
USPC ..... 15/144.1, 228; 29/428
See application file for complete search history.

(56) References Cited

U.S. PATENT DOCUMENTS

| | | | | | |
|---|---|---|---|---|---|
| 1,372,370 | A | * | 3/1921 | Reid | 401/139 |
| 2,903,730 | A | | 9/1959 | Murphy | |
| 4,184,224 | A | | 1/1980 | Joffre | |
| 5,249,886 | A | * | 10/1993 | Huerta, Jr. | 404/89 |
| 5,312,134 | A | * | 5/1994 | Goode et al. | 280/822 |

FOREIGN PATENT DOCUMENTS

| | | | |
|---|---|---|---|
| EP | 0277102 | A2 | 8/1988 |
| WO | 2009157862 | A1 | 12/2009 |

* cited by examiner

*Primary Examiner* — Randall Chin
(74) *Attorney, Agent, or Firm* — Capitol City TechLaw

(57) ABSTRACT

In a mop head (1) having a handle attachment (2) that is displaceable along a frame (29), the handle attachment has a slider (3) that is displaceable (direction S) in a guide groove (20) in the frame. The slider has at least one engagement surface for frictional engagement with a respective cooperating surface of the guide groove and biasing means that with a force bias the surface/-s of the slider against the cooperating surface/-s of the guide groove. The handle attachment with the slider are depressable against the force from the biasing means, for relieving the engagement between the surface/-s of the slider and of the guide groove.

10 Claims, 5 Drawing Sheets

B-B

FIG. 6
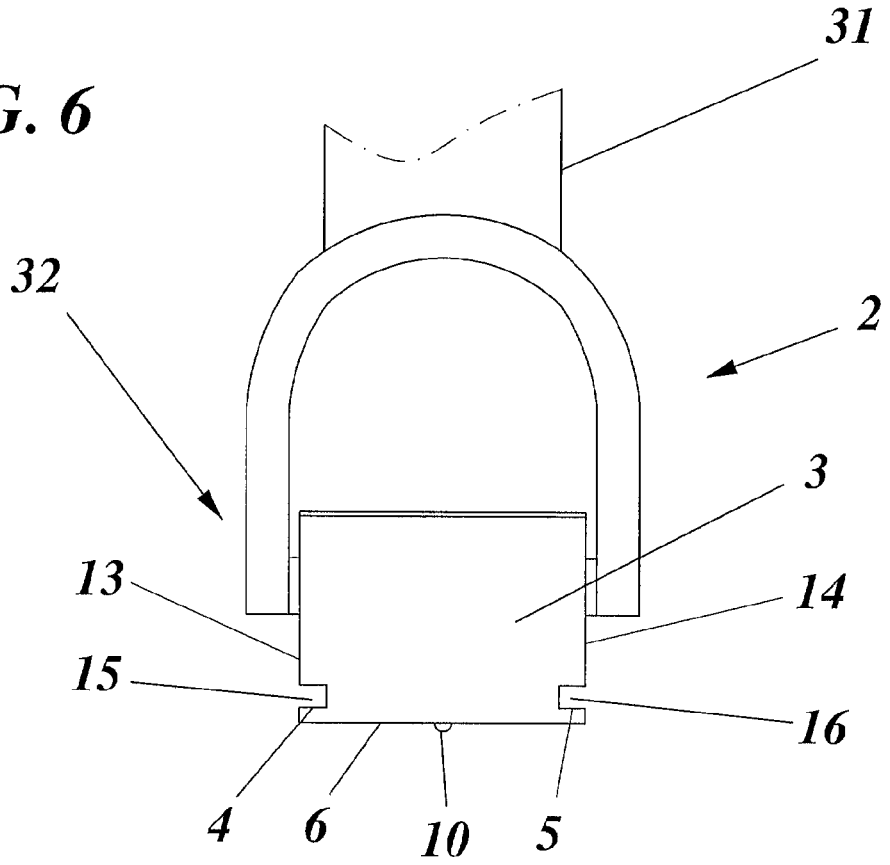
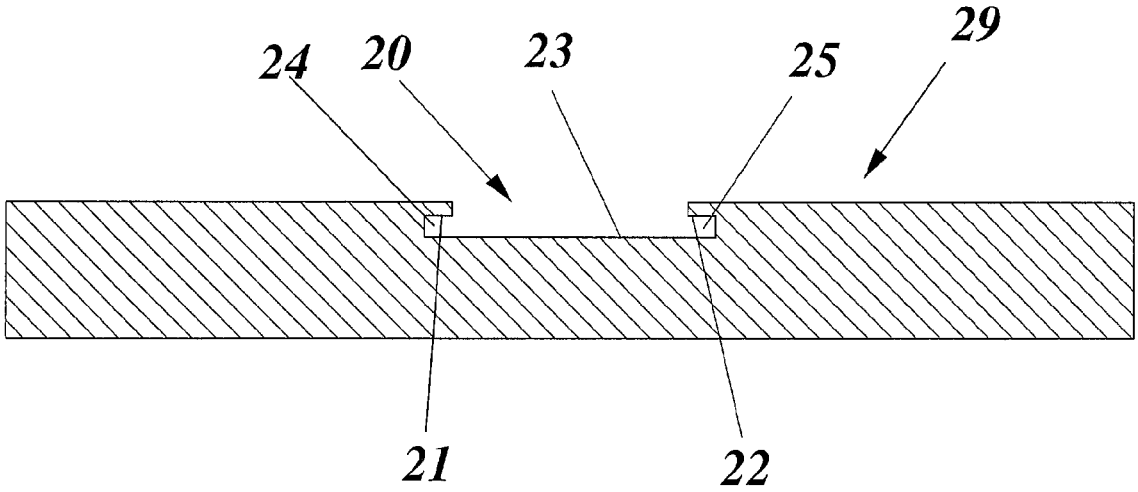
FIG. 7
A-A

B-B

B-B

DISPLACEABLE ATTACHMENT

TECHNICAL FIELD

The invention generally concerns cleaning utensils and more specifically relates to a mop head having a displaceable handle attachment.

BACKGROUND

For cleaning purposes, for dry or wet cleaning of above all floors, it is common in the present time to use mops secured to mop holders or heads being equipped with handles. Such mops are employed in professional cleaning but increasingly also in home cleaning. The mops are normally fitted onto the frame of the mop head, which is basically a plate having essentially the shape of a rectangle or a rhomboid, and are attached to the frame in an appropriate manner. In the centre of the frame is provided a handle attachment in which a handle may be mounted, normally by means of a quick connection in order to enable easy assembly and disassembly. The handle attachment is articulated with one or more joints to provide a comfortable working position during sweeping while simultaneously allowing the frame and the fitted mop to lie flat on the floor.

A traditional shortcoming of this type of mop head was that the handle attachment was attached stationary at the centre of the frame. Such a design limits the accessibility, e.g. under cupboards, cabinets or other furniture or behind radiators, to less than half the length of the frame. This problem has been solved by providing the handle attachment so as to be displaceable roughly between one end of the frame and its centre. In this manner the handle attachment may be adjusted so that almost the entire length of the frame may be used under hindering furniture etc. In existing designs it is relatively difficult to release the mop head handle attachment from the frame in order to move it and to secure the handle attachment to the frame again, respectively. This is usually done by manually shifting a lock arm placed down by the frame or by actuating a foot operated knob of the general type found on vacuum cleaner nozzles.

SUMMARY

A general object of the present invention is therefore to suggest a solution that eliminates the above discussed shortcomings and problems.

A more specific object of the invention is to enable improved and uncomplicated displaceability of a handle attachment relative to a frame of a mop head.

Another specific object of the invention is to provide a simple and uncomplicated method for practical and effective displacement between a handle attachment and a frame of a mop head.

These and other objects are met by the invention as defined by the accompanying claims.

The invention generally relates to a mop head having a frame and a handle attachment that is moveable along the frame. According to a first aspect a basic idea is to provide a mop head where the handle attachment has a slider being displaceable in a guide groove of the frame. The slider has at least one surface for frictionally engaging a surface of the guide groove and biasing means biasing the surface of the slider against the surface of the guide groove, whereby the handle attachment and its slider are depressable against the force of the biasing means to relieve the engagement between the slider and guide groove surfaces.

Such a configuration has the advantages of providing very advantageous, quick, practical and comfortable locking and release of the handle attachment relative to the frame.

In accordance with a further aspect of the invention there is provided an improved method of locking and releasing, respectively, a mutual displaceability between a handle attachment and a frame of such a mop head. Basically, the handle attachment and its slider are depressed towards the frame by means of an attached handle, so that the slider is released from a biased frictional engagement with the frame. During continued depression the handle attachment is then moved to a desired position and when the handle attachment and its slider are relieved again the handle attachment is locked in a new desired position.

With such a method, handle attachment locking and release may be performed very quickly and conveniently standing in an upright position, and without any unstable foot operation.

Further developments of the invention and embodiments thereof are specified in the subclaims. Other advantages of the invention will become clear when reading the below detailed description of embodiments of the invention.

BRIEF DESCRIPTION OF THE DRAWINGS

The invention and further objects and advantages thereof will be best understood by reference to the following description taken together with the accompanying drawings, in which:

FIG. 6 is a partly schematical end view of the handle attachment shown in FIGS. 3-5;

FIG. 7 is a cross section along line A-A in FIG. 1 through the frame of the mop head according to FIGS. 1 and 2;

DETAILED DESCRIPTION

Figure 1:
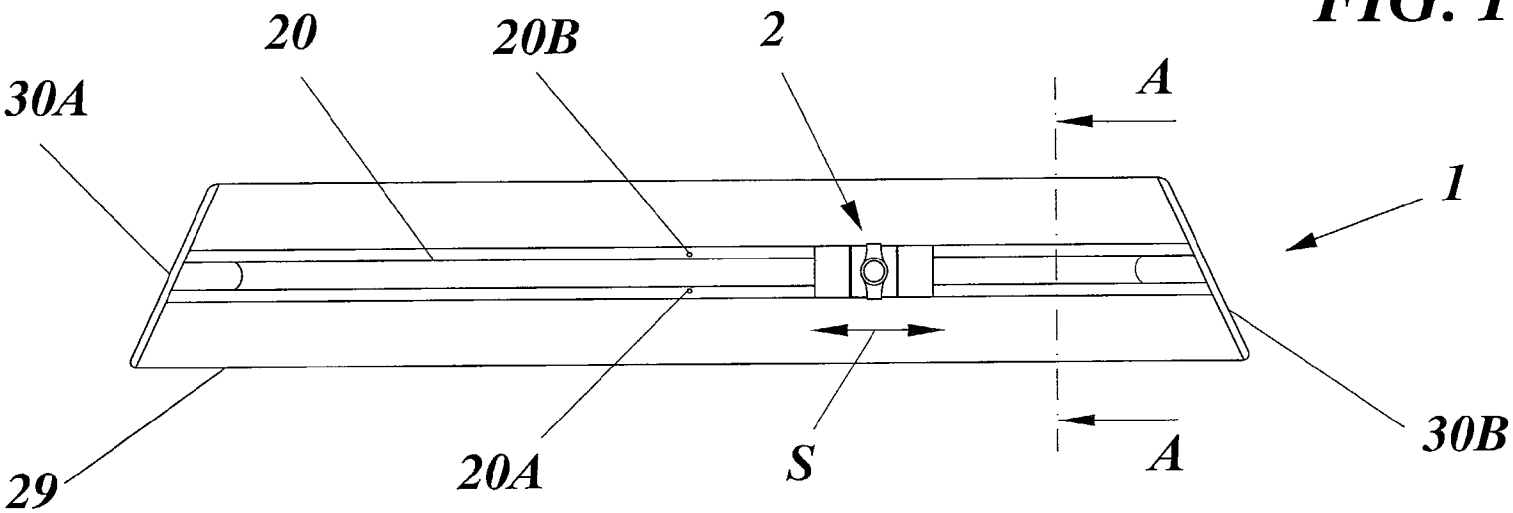
FIG. 1 is a partly schematical plan view from above of an embodiment of a mop head according to the invention.

The principles of the invention will be explained with reference to the exemplifying embodiment of the invention that is illustrated in the accompanying drawings and that is an example of an application of the basic principles of the invention to one type of mop head or holder. It is emphasized that the illustrated embodiment has the sole purpose of illustrating a presently preferred design according to the invention and is not intended to limit the invention to the details shown in the drawings, As was discussed in the introduction a shortcoming of existing mop heads having some kind of relative displaceability between the frame and the handle attachment is that they are difficult and inconvenient to adjust between a locked and a mutually displaceable condition. In view thereof the inventor has now realized that the handling of the mop head would be facilitated considerably if the actual manipulation for obtaining this adjustment could be performed separate from the actual mop frame, i.e. without any hand or foot operation directly at the actual frame. According to the invention this is basically achieved by concentrating the actual manipulation to a handle that is connected to the mop head. Thereby, it will be possible to perform the adjustment between locked and displaceable condition in a next to natural working position during sweeping with the mop head.

Figure 2:
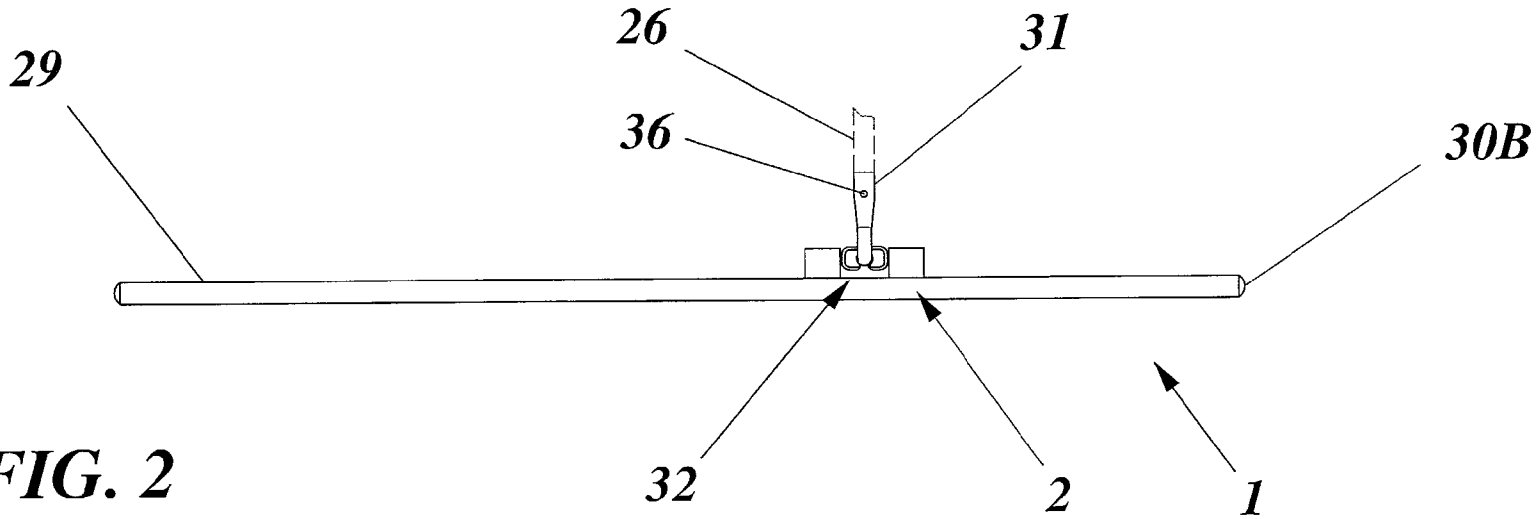
FIG. 2 is a partly schematical side view of the mop head of FIG. 1.
Figure 3:
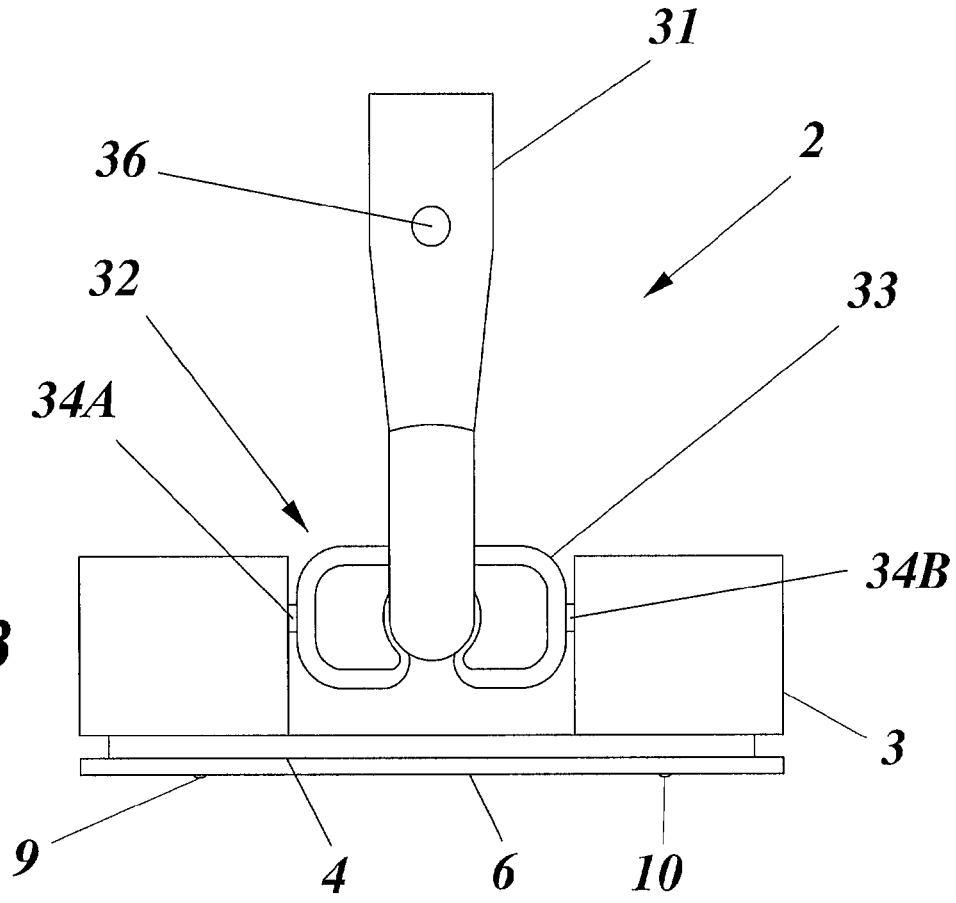
FIG. 3 is a detailed view from the side of a handle attachment in the mop head of FIGS. 1 and 2.
Figure 4:
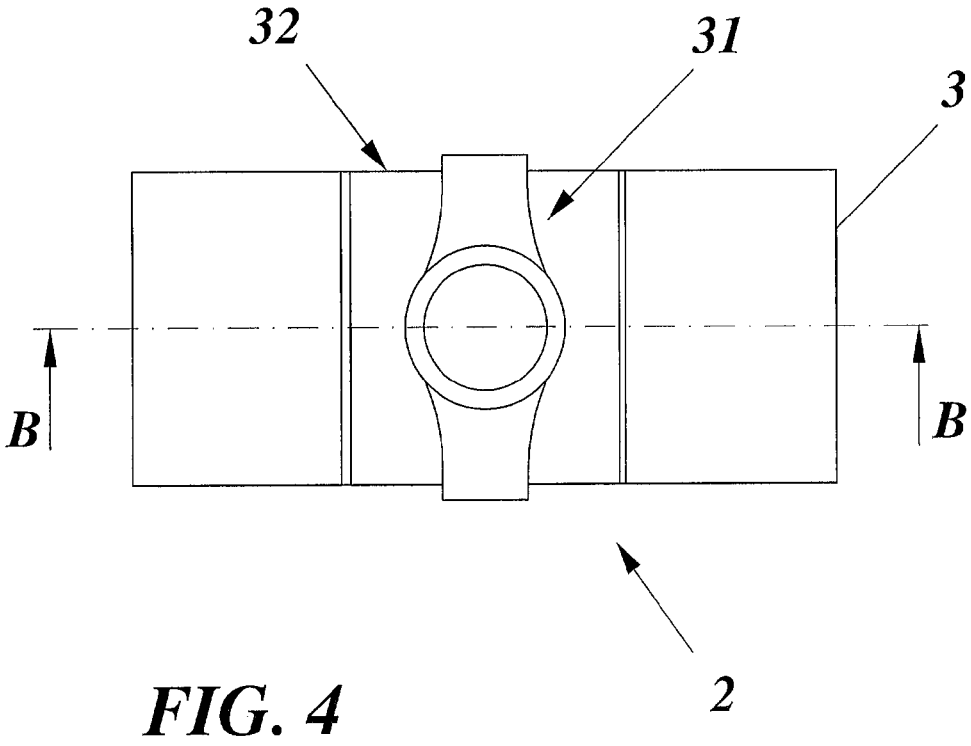
FIG. 4 is a detailed view from above of the handle attachment of FIG. 3.
Figure 5:
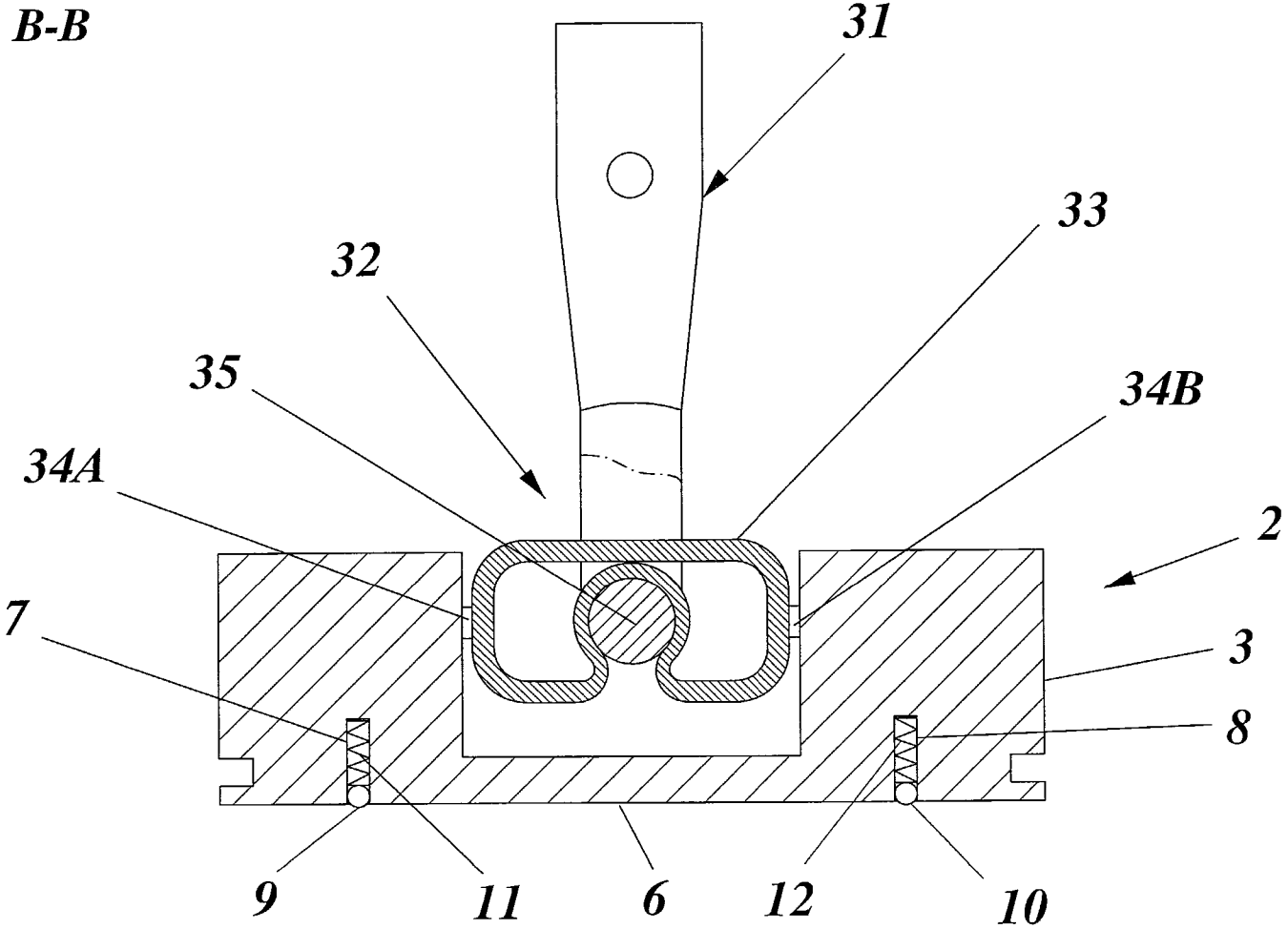
FIG. 5 is a longitudinal section along line B-B in FIG. 4, through the handle attachment of FIGS. 3 and 4.

In the basic embodiment that is illustrated in FIGS. 1 and 2, the mop head 1 according to the invention has an attachment 2 for a handle 26, indicated in FIG. 2, said attachment being displaceable along a frame 29. The frame 29 is provided with a guide groove 20 that is extended substantially along its longitudinal center line, not specifically designated. In a manner that is in itself previously known, the frame 29 has beveled end sides that are closed by end pieces 30A, 30B that preferably also close the ends of the guide groove 20, The handle attachment 2 includes a handle sleeve 31 that is releasably interconnectable with the handle 26. In particular, the handle sleeve 31 of the handle attachment 2 may have an opening 36 for snap-fit reception of a locking pin (not specifically shown) or similar means of the handle 26. Through an articulated mechanism 32 the handle attachment 2 is pivotally connected to the frame 29 in the manner that will now be more closely described in connection with primarily FIGS. 3-5. The articulated mechanism 32 is of the universal joint type, for pivoting around two substantially perpendicular axes. Thereby, the handle attachment 2 in a lower end of the handle sleeve 31 has a pivot pin 35 that is received for rotation in a double joint piece 33 that is in turn journalled for rotation in a slider 3 through pivot pins 34A, 34B. The slider 3 is displaceably received in the guide groove 20 of the frame 29, for displacement in the dual displacement direction S. Preferably, this displaceability of the slider 3 in the guide groove 20 is restricted by stops 20A, 20B provided at the guide groove, essentially centrally in the frame 29.

Figure 8:
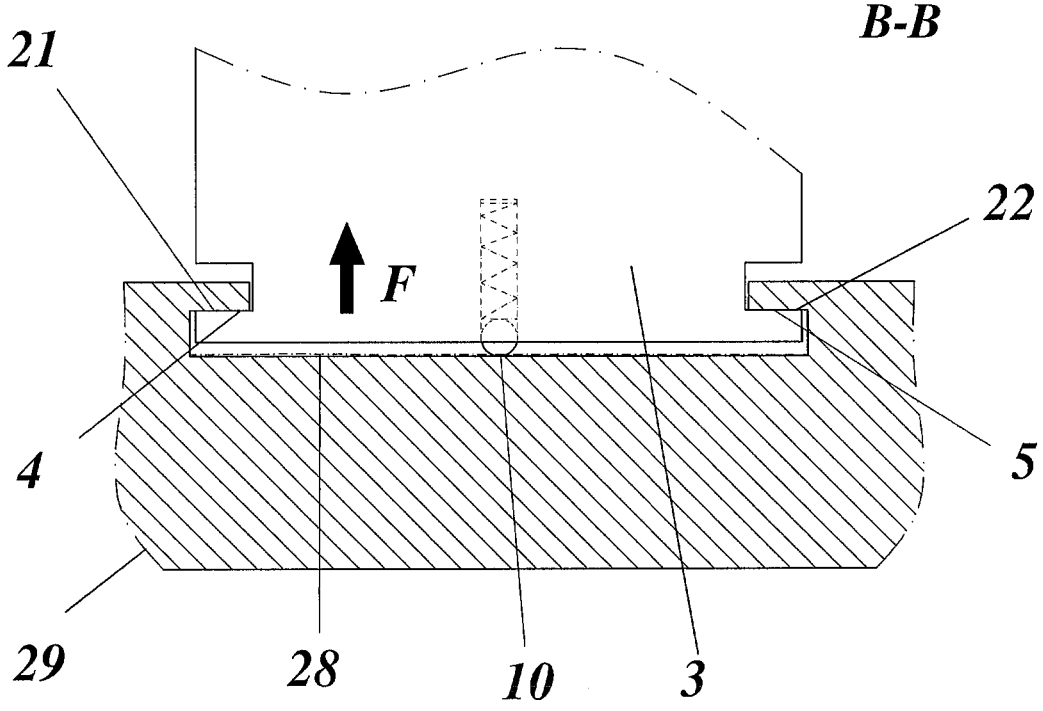
FIG. 8 is a detailed view of the handle attachment slider and of the frame guide groove in a locking position and in cross section.

The slider 3 has at least one, but in this illustrated embodiment two engagement surfaces 4, 5 for frictional engagement with a respective, cooperating surface 21, 22 of the guide groove 20 (see especially FIGS. 6-9). The slider further has biasing means 9, 10, 11, 12 that in the relieved condition of the handle 26, the handle attachment 2 and the slider 3 bias the slider engagement surfaces 4, 5 against cooperating guide groove surfaces 21, 22 with a force F (FIG. 8). The biasing means include one or several slide means that in the exemplifying embodiment are formed as balls 9, 10 acting between a lower surface 6 of the slider 3 and a bottom 23 of the guide groove 20. The slide means 9, 10 are each movably received in a respective bore 7, 8 that opens in the lower surface 6 of the slider 3 and that also accommodates a respective associated spring 11, 12 applying the biasing force F that from above loads the slide means 9, 10. In the assembled condition the slide means 9, 10 are thus provided between the lower surface 6 of the slider 3 and the bottom surface 23 of the guide groove 20.

It is clear from FIG. 6 that a lock groove 15, 16 that is extended in the direction S of displacement of the slider 3 is formed in each of the side surfaces 13, 14 of the slider 3 that in the assembled condition are essentially parallel to the guide groove 20. A lower surface of each of the lock grooves 15, 16 does thereby form the respective engagement surface 4, 5 for the slider 3. Referring especially to FIG. 7 it is clear that the guide groove 20 of the frame 2 has undercut side portions 24, 25 extended in the displacement direction S of the slider 3. An upper surface of each of said undercut side portions thereby forms the respective surface 21, 22 of the guide groove 20 that cooperates with the respective engagement surface 4, 5 of the slider 3. The function of and cooperation between said surfaces 4, 5, 21, 22 of the slider 3 and the guide groove 20 will be described more closely below, in association with FIGS. 8 and 9.

Figure 9:
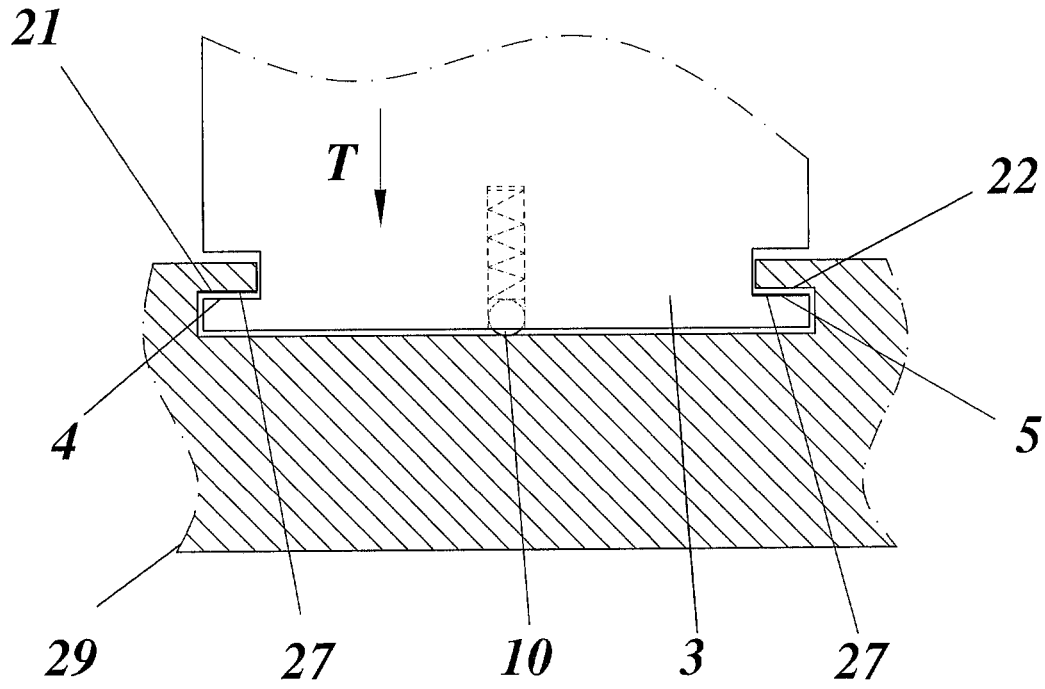
FIG. 9 is a detailed view similar to that of FIG. 8 but showing the handle attachment slider and the frame guide groove in a released displaceable position.

The surface/-s 4, 5 of the slider 3 and/or the surface/-s 21, 22 of the guide groove 20 cooperating therewith may, when called for, be provided with a friction increasing structure or coating 27 that promotes a secure mutual locking between the slider 3 and the frame 29 in the functional locking position. This is indicated in FIG. 9. Such a friction increasing surface may e.g. include a structure formed with elevated and recessed portions, respectively, or a coating of a material similar to a sand paper and may be arranged at one or both of the respective cooperating surfaces of the slider 3 and the guide groove 20, respectively. In a corresponding manner the lower surface 6 of the slider 3 and/or the slide means 9, 10 and/or the bottom 23 of the guide groove 20 may be provided with a friction-decreasing coating 28 (indicated in FIG. 8) promoting a secure mutual displacement between the slider 3 and the frame 29 in the mutually disengaged condition.

A method according to the invention for permitting locking and release, respectively, of the handle attachment 2 with regard to a mutual displaceability of the mop head 1 attachment 2 and the frame 29 is performed with the now described mop head 1 serving as an example. As was indicated earlier the slider 3 and the frame 29 are locked to each other through the biasing force F and with regard to a mutual displaceability when the mop head 1 is fully relieved or in a normal working position, i.e. without any essential loading of the handle attachment 2 and the slider 3 perpendicular to the frame 29.

When a mutual displacement between the handle attachment 2 and the frame 29 is desired the handle attachment 2 and thereby its slider 3 are depressed by means of the connected handle 26. They are depressed in a direction T (see FIG. 9) that is substantially perpendicular to the frame 29 attached to the slider 3. As a result thereof the engagement surfaces 4, 5 of the slider 3 are released from the biased frictional engagement with the cooperating surfaces 21, 22 of the frame guide groove 20 so that during continued depression the handle attachment 2 and the slider 3 may be displaced to a desired position in the guide groove 20. Finally, the handle attachment 2 and its slider 3 are then relieved so that the slider 3 and thereby the handle attachment 2 are locked in the new desired position.

In alternative, but not specifically illustrated embodiments of the invention variants or modifications of the different illustrated parts of the utility may be used without departing from the scope of the invention. Above all, the invention is not restricted to the illustrated and described schematical configuration of the cooperating slide means and biasing means or of the guide groove, but includes variants and modifications thereof that provide the same basic functions as described above. Although the invention has been illustrated and described with specific reference to an application for one type of mop head the invention shall in no way be restricted to this actual application. The basic principles of the invention may thus be applied to other types of mop heads.

The invention has been described in connection with what is presently considered the most practical and preferred embodiment, but it is to be understood that the invention is not limited to the disclosed embodiment. The invention is therefore intended to cover various modifications and equivalent arrangements included within the spirit and scope of the appended claims.

The invention claimed is:

1. A mop head comprising:

a frame including a guide groove;

a handle attachment being displaceable along the frame, the handle attachment including a slider that is received in the guide groove for displacement relative to the frame in a displacement direction;

wherein the slider has at least one engagement surface for frictional engagement with a respective cooperating surface of the guide groove;

wherein biasing means is provided for biasing the engagement surface of the slider against the cooperating surface of the guide groove with a force (F);

wherein the handle attachment and the slider are depressable against the force (F) from the biasing means to separate the engagement surface of the slider from the cooperating surface of the guide groove; and wherein the biasing means includes slide means for being loaded with t force (F) and for acting between a lower surface of the slider and a bottom of the guide groove.

2. The mop head according to claim 1, wherein the biasing means includes a spring that applies the force (F) to the slide means; and wherein the spring and the slide means are moveably received in a respective bore provided in the slider, the bore opening into the lower surface of the slider.

3. The mop head according to claim 1, wherein the slide means is a ball.

4. The mop head according to claim 1, wherein the slider has at least one side surface provided with a lock groove extending in the displacement direction; and wherein a lower surface of the lock groove forms the engagement surface of the slider.

5. The mop head according to claim 1, wherein the guide groove in the frame has at least one undercut side portion extending in the displacement direction; and wherein an upper surface of the undercut side portion forms the cooperating surface of the guide groove.

6. The mop head according to claim 1, wherein at least one of the engagement surface of the slider and the cooperating surface of the guide groove has a structure or coating increasing friction.

7. The mop head according to claim 1, wherein a coating decreasing friction is applied to at least one of the lower surface of the slider, the slide means, and the bottom of the guide groove.

8. A method of locking and releasing a handle attachment of a mop head according to claim 1 with regard to a mutual displaceability between the handle attachment and the frame of the mop head, the method comprising:

depressing the handle attachment and the slider with the aid of a handle attached thereto in a direction towards the frame, such that the engagement surface of the slider separates from the cooperating surface of the guide groove;

under continued depression, displacing the slider in the displacement direction to a desired position in the guide groove; and relieving the handle attachment and the slider so that the slider and thereby the handle attachment are locked in the desired position.

9. The method according to claim 8, wherein the handle attachment and the slider are depressed in a direction that is perpendicular to the displacement direction.

10. A mop head comprising:

a frame including a guide groove;

a handle attachment including a slider that is received in the guide groove for displacement relative to the frame in a displacement direction, the slider having an engagement surface confronting a cooperating surface of the guide groove; and a biasing mechanism to influence the engagement surface of the slider against the cooperating surface of the guide groove;

wherein the handle attachment and the slider are depressable against the influence from the biasing mechanism to separate the engagement surface of the slider from the cooperating surface of the guide groove; and wherein the biasing mechanism includes a ball loaded with a force that influences a lower surface of the slider away from a bottom surface of the guide groove.

* * * * *